US006056284A

United States Patent [19]

Shin

[11] Patent Number: 6,056,284

[45] Date of Patent: May 2, 2000

[54] ROLLER CONTROLLING DEVICE

[75] Inventor: Sang-Yob Shin, Kyonggi-do, Rep. of Korea

[73] Assignee: SamSung Electronics Co., Ltd., Kyungki-do, Rep. of Korea

[21] Appl. No.: 09/144,542

[22] Filed: Aug. 31, 1998

[30] Foreign Application Priority Data

Aug. 30, 1997 [KR] Rep. of Korea ..... 97-43706

[51] Int. Cl.[7] ..... B65H 3/06

[52] U.S. Cl. ..... 271/114; 271/117; 271/127

[58] Field of Search ..... 271/114, 117, 271/118, 126, 127

[56] References Cited

U.S. PATENT DOCUMENTS 4,236,660 12/1980 Kanemura .
4,734,806 3/1988 Kamatsu .
5,201,873 4/1993 Kikuchi et al. ..... 271/117 X
5,318,631 6/1994 Tsukamoto .

FOREIGN PATENT DOCUMENTS 464815 1/1992 European Pat. Off. ..... 271/117

*Primary Examiner*—David H. Bollinger
*Attorney, Agent, or Firm*—Robert E. Bushnell, Esq.

[57] ABSTRACT

A roller control device is provided that both sets sheets for printing and feeds them into an electrophotographic apparatus. The roller control device is may be constructed using a pickup roller that is mounted on a central axle and is used for feeding sheets of paper from a paper tray into an electrophotographic apparatus. A disk may be installed on the central axle between the pickup gear and the pickup roller. A solenoid may be mounted to the housing of the apparatus underneath the disk to modulate the movement of the disk using a latch that is interposed between the disk and the solenoid. A cam is installed on the central axle between the disk and the pickup roller to slidably contact a lift plate to set sheets of paper. The roller control device is usable in a compact apparatus, is economical to manufacture, and is easy to repair and maintain.

20 Claims, 6 Drawing Sheets

ROLLER CONTROLLING DEVICE

CLAIM OF PRIORITY

This application makes reference to, incorporates the same herein, and claims all rights accruing thereto under 35 U.S.C. §119 through my patent application entitled Sheet Feeding Device of Laser Beam Printer earlier filed in the Korean Industrial Property Office on Aug. 30$^{th}$, 1997 and there duly assigned Ser. No. 1997/43706.

BACKGROUND OF THE INVENTION

1. Field of the Invention

The present invention relates to paper loaders for an electrophotographic apparatus and, more specifically, to a controlling device for a pick-up roller.

2. Background Art

An electrophotographic image forming apparatus, such as a copier, a printer, a laser beam printer, or a facsimile, prints an image onto a sheet of paper that is loaded into the apparatus from a paper cassette that contains a stack of paper. To sequentially feed the sheets of paper from the paper cassette a sheet feeding device is used.

A sheet feeding device may be constructed using a pickup roller, also referred to as a roller, that sequentially feeds the top sheet of paper from a paper cassette into an electrophotographic apparatus. A rubber layer may be mounted on the outer surface of the pickup roller to increase the frictional interaction between the paper and the roller. The central axle is fixed to a frame. A pickup gear is installed at one end of the central axle to receive power that is then transmitted to the central axle. A bushing is fixed to the central axle and facing the pickup gear.

One method of controlling the feeding operation is to use a clutch spring to transmit the driving force that is transferred from a motor to the outer surface of a hub of the pickup gear. The force is then transferred to the outer surface of a hub of the bushing that is attached to the central axle.

Other techniques for modulating rollers are shown, for example, in U.S. Pat. No. 5,318,631 to Tsukamoto entitled Pressure Control Device for a Pressure Roller, U.S. Pat. No. 4,734,806 to Komatsu entitled Cam Plate for Positioning Head Base and Pinch Roller in Tape Player, and U.S. Pat. No. 4,236,660 entitled Solenoid Clutch Mechanism. The contemporary art does not provide a roller control device that is able to control the feeding of paper, that sets paper prior to feeding, and that is economical to produce.

As such, I believe it may be possible to improve on the prior art by providing a roller control device that does not require an additional sheet setting mechanism, that controls the feeding of sheets into an electrophotographic apparatus, that is usable in a compact apparatus, that is economical to manufacture, and that is easy to repair and maintain.

SUMMARY OF THE INVENTION

Accordingly, it is an object of the present invention to provide an improved roller control device.

It is another object to provide a roller control device that does not require an additional sheet setting mechanism.

It is still another object to provide a roller control device modulates the feeding of sheets into an electrophotographic apparatus.

It is yet another object to provide a roller control device that is suitable for use with a compact electrophotographic apparatus.

It is still yet another object to provide a roller control device that is easy to repair and maintain.

It is a further object to provide a roller control device that is economical to manufacture.

To achieve these and other object, a roller control device is provided that may be constructed using a pickup roller that is mounted on a central axle and is used for feeding sheets of paper from a paper tray into an electrophotographic apparatus. A gear is installed on an end of the central axle to transmit power from a motor to the central axle. A disk may be installed on the central axle between the pickup gear and the pickup roller. The disk may be constructed with an abutment positioned along its outer surface. A solenoid may be mounted to the housing of the apparatus underneath the disk to modulate the movement of the disk using a latch that is interposed between the disk and the solenoid. A cam is installed on the central axle between the disk and the pickup roller to slidably contact a lift plate, also referred to as a plate. The plate has a axle that is pivotally fixed so that sheets can be positioned into a set position for feeding.

BRIEF DESCRIPTION OF THE DRAWINGS

A more complete appreciation of this invention, and many of the attendant advantages thereof will be readily apparent as the same becomes better understood by reference to the following detailed description when considered in conjunction with the accompanying drawings in which like reference symbols indicate the same or similar components, wherein.

DETAILED DESCRIPTION OF THE DRAWINGS

Figure 1:
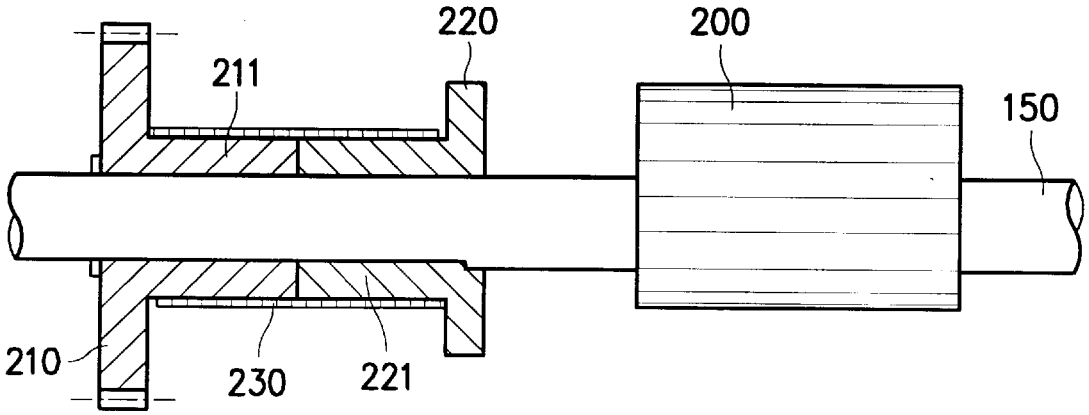
FIG. 1 is a cross-sectional view of a sheet feeding device.

Turning now to the drawings, FIG. 1 illustrates a sheet feeding device. Pickup roller 200 sequentially feeds the top sheet from a paper cassette and is mounted on central axle 150. A rubber layer (not shown) is mounted on the outer surface of pickup roller 200 to increase the frictional interaction between the paper and the roller. Central axle 150 is fixed to a frame (not shown). Pickup gear 210 is installed at one end of central axle 150. Pickup gear 210 receives power that is transmitted to the central axle via an external power source, such as a motor (not shown). Bushing 220 is fixed to central axle 150 and receives power from the hub of the pickup gear via the clutch spring 230. Clutch spring 230 transmits the force that is transferred to the outer surface of hub 211 of pickup gear 211. The force transmitted to pickup gear 210 is then transferred to the outer surface of hub 221 of bushing 220.

Figure 2:
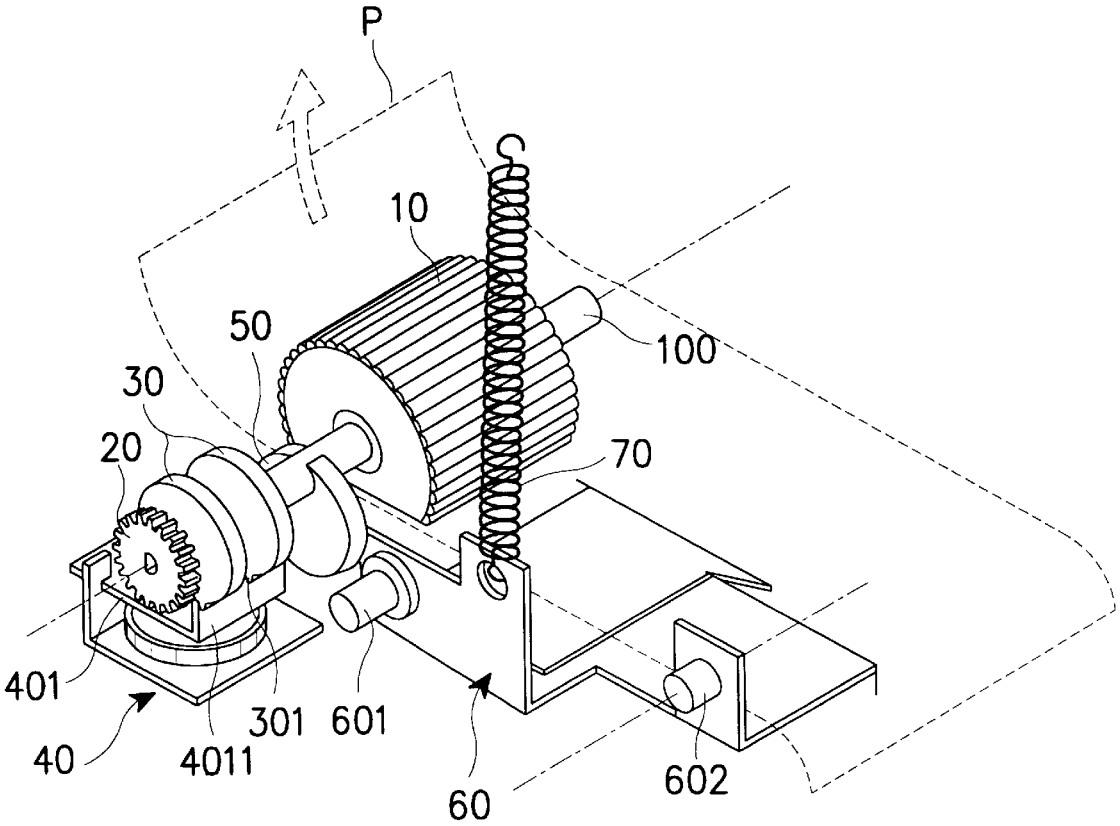
FIG. 2 is a perspective view of a roller controlling device as constructed according to the principles of the present invention.

FIG. 2 illustrates a roller controlling device including a solenoid 40 controlling a latch 401 and a paper aligner 500, also referable to as a sheet feeding device, as constructed according to the principles of the present invention. Referring to FIG. 2, a pickup gear, also referred to as a gear, 20 is mounted on one end of central axle, also referred to as an axle, 100 to transmit power to pickup roller, also referred to as a roller, 10. Disks 30 may be installed on axle 100, between gear 20 and the roller 10. Solenoid 40 controls the rotation of disks 30 by manipulating a latch that engages the disks to prevent the rotation of the roller. Cam 50 may be positioned between disks 30 and roller 10. Lift plate, also referred to as a plate, 60 turns around hinge axle 602 and makes sliding contact with cam 50. Tension coil spring 70 provides a torque to the lift plate 60.

Gear 20 receives force via an idle gear (not shown) from a driving device. Multiple disks 30, preferably two disks, may be installed and positioned apart from gear 20. Disks 30 each has abutment 301 of a predetermined size projecting from an outer surface along a radial edge of the disk.

Figure 3A:
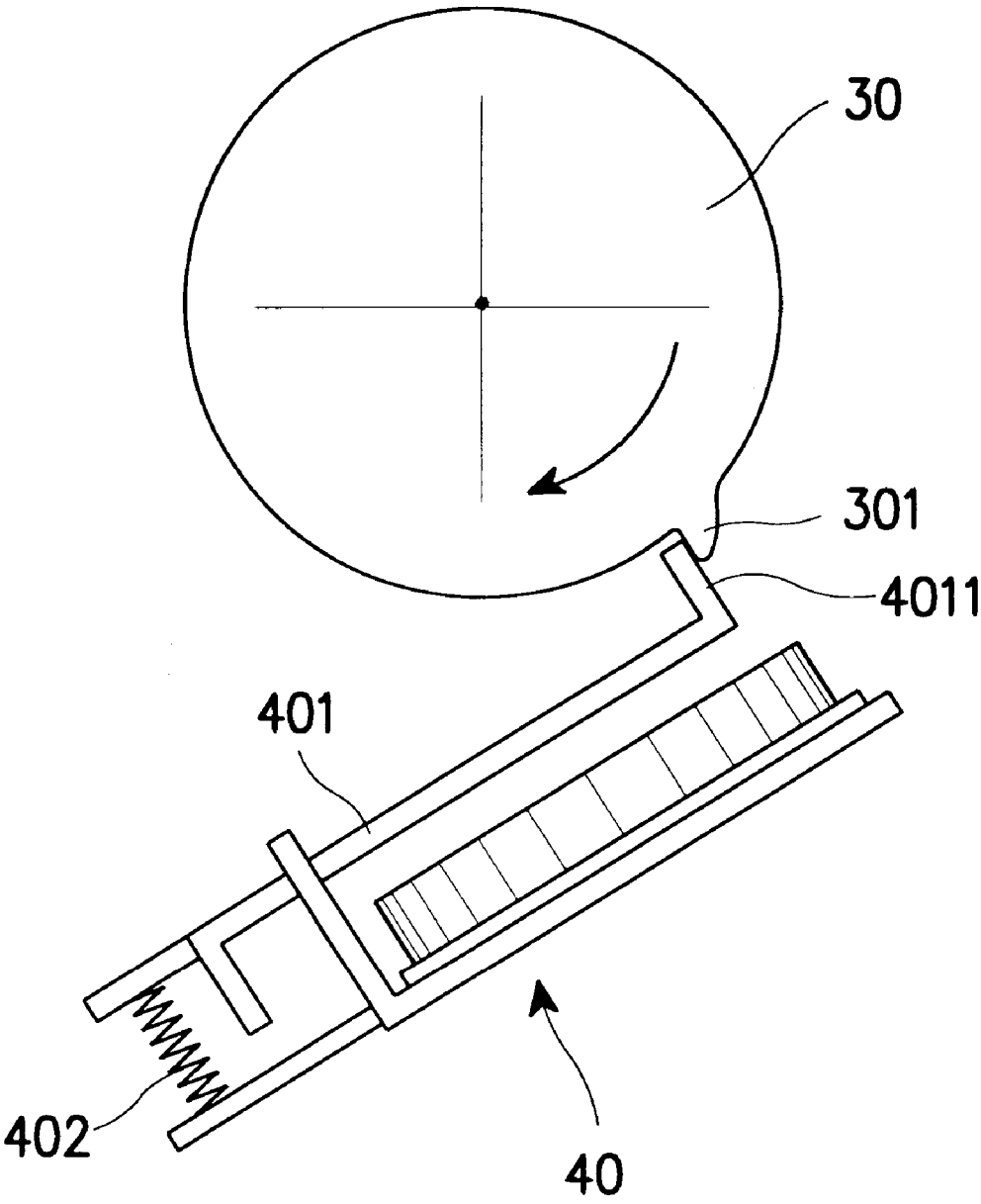
FIG. 3A is a front view of the disk of the roller controlling device of FIG. 2 engaged with a latch to prevent the feeding of sheets into an electrophotographic apparatus.
Figure 3B:
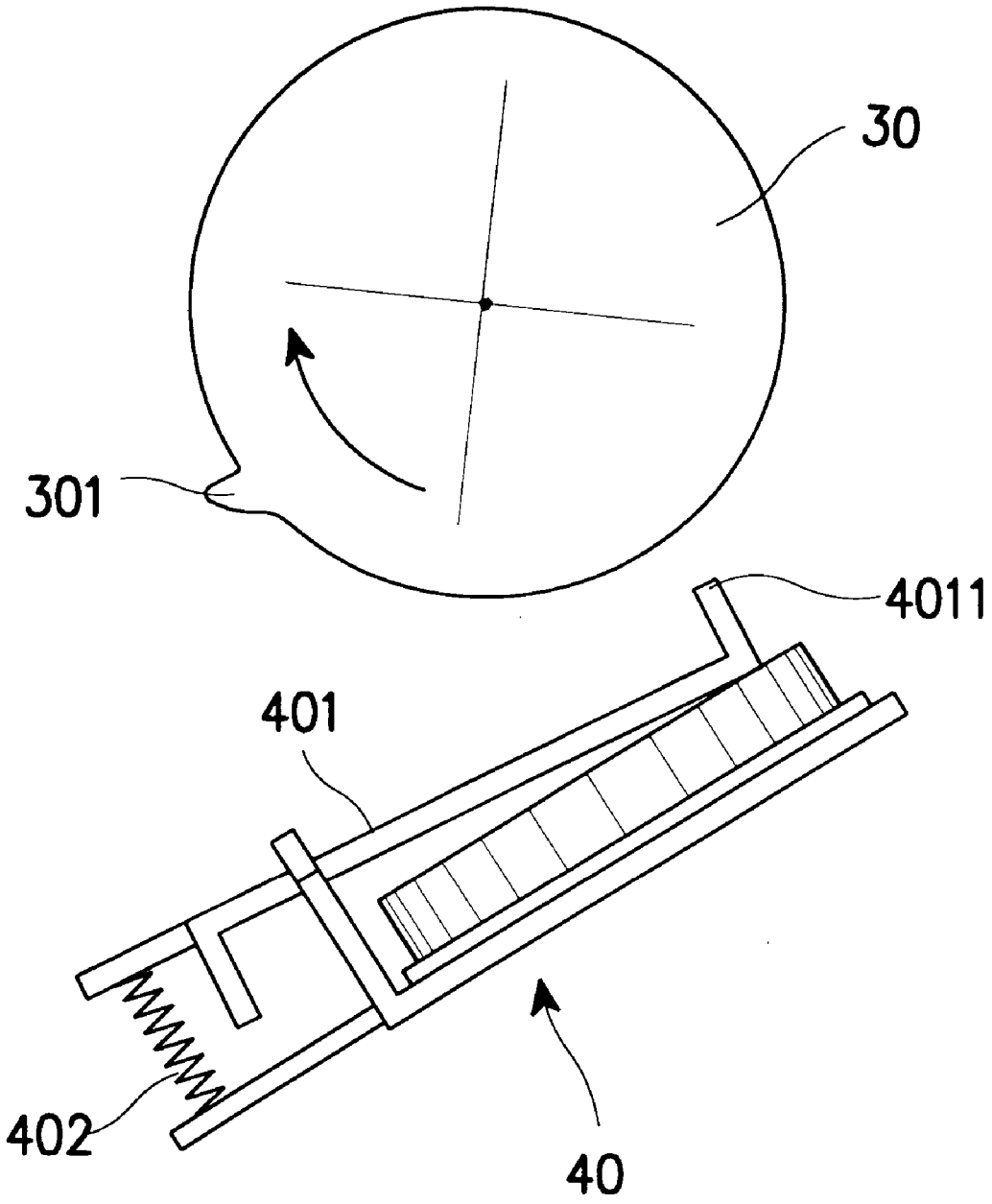
FIG. 3B is a front view of the disk of FIG. 2 rotating while the solenoid is activated, thus allowing the feeding of sheets of a printable medium into the electrophotographic apparatus.

As shown in both FIGS. 3A and 3B, disk 30 rotates in the same direction at the same speed as gear 20. To control the rotation of disk 30, solenoid 40 is installed underneath latch 401 that is also underneath disk 30. Latch 401 is pivotally mounted over solenoid 40 and is biased by elastic member 402 to make contact with disk 30. Solenoid 40 is able to pull latch 401 towards solenoid 40 to allow disk 30 to rotate freely.

When the solenoid is deactivated, as shown in FIG. 3A, latch 401 rotates counterclockwise, due to the biasing force of spring 402, and engages disk 30. When latch 401 engages disk 30, projection 4011 of latch 401 makes contact 2 with abutment 301 of disk 30 resulting in the stopping of the rotation of the roller.

When solenoid 40 is activated, as shown in FIG. 3B, latch 401 rotates clockwise towards solenoid 40. This disengages projection 4011 from abutment 301 and allows roller 10 to rotate. Hence, the disk 30 rotates in an arrow direction.

Figure 4A:
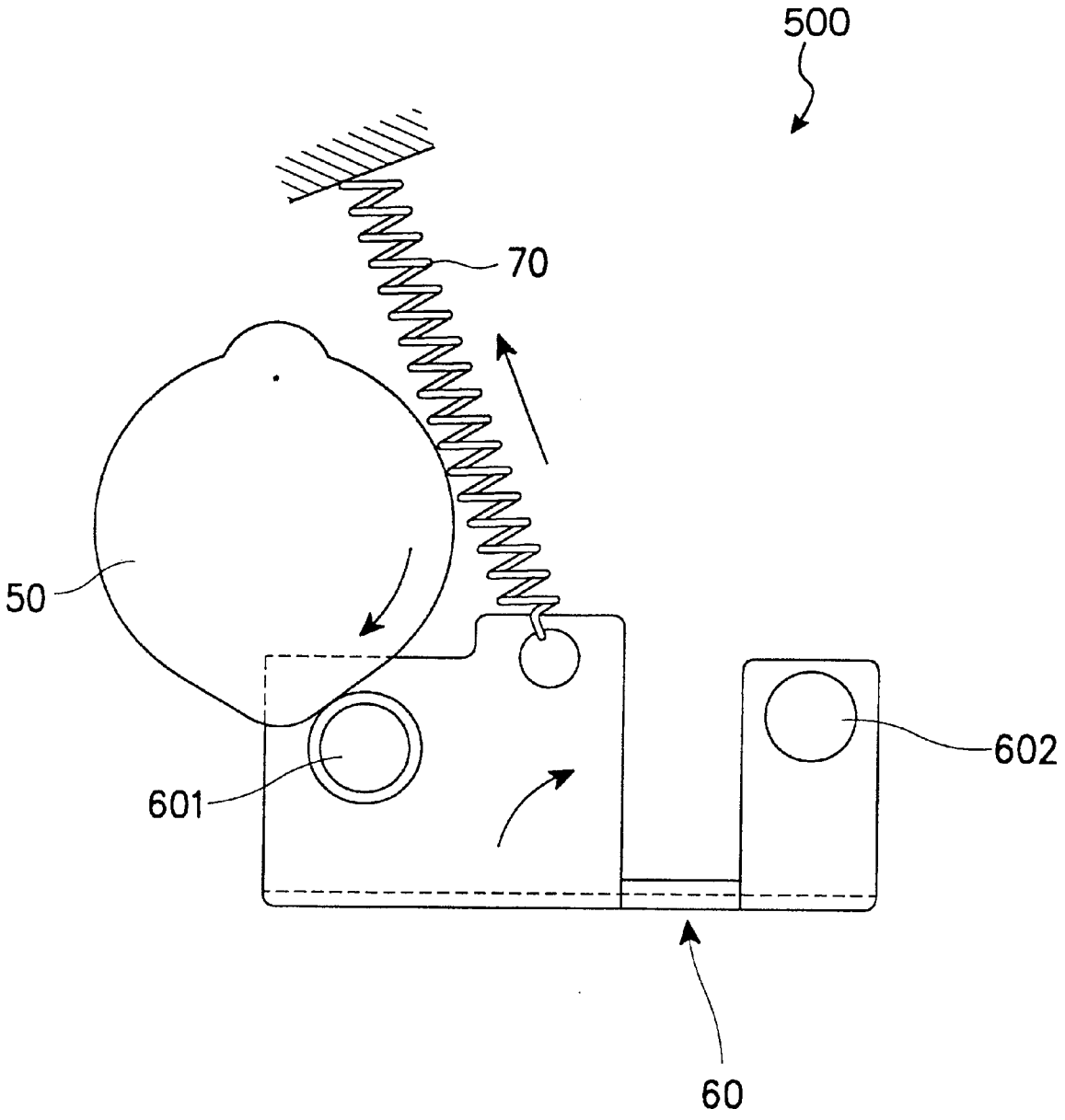
FIG. 4A is a front view of a paper aligner showing the lift plate when it is not set according to the principles of the present invention.
Figure 4B:
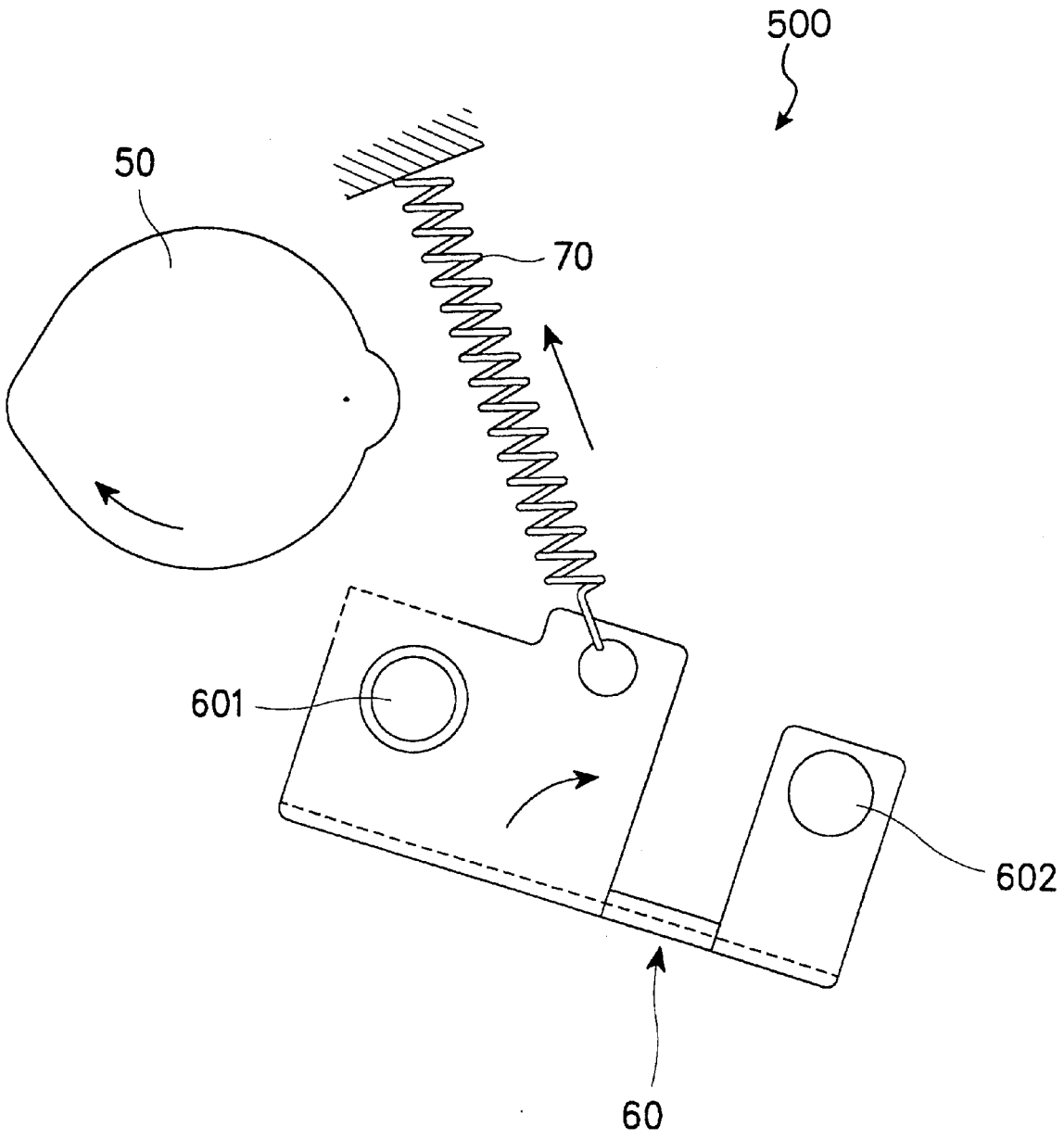
FIG. 4B is a front view of a paper aligner showing the lift plate of FIG. 2 in the set position.

FIGS. 4A and 4B shows paper aligner 500 including cam 50 which is situated beside disk 30 and is mounted eccentrically downward on central axle 100. The eccentric positioning of cam 50 on central axle 100 results in cam 50 rotating with a trace. Pole 601 is installed on lift plate 60 to contact the outer surface of cam 50 during a certain portion of the rotation of cam 50. Elastic member 70 is also attached to lift plate 60 to provide a force to lift plate 60 opposite to that provided by the cam and pole interaction. Lift plate 60 undergoes limited reciprocal rotational motion around hinge axle 602 due to the sliding contact between pole 601 and cam 50.

The process of the roller control device picking up and feeding a sheet of printable medium into the electrophotographic apparatus will be described with reference to FIG. 2. Top sheet P is stacked on lift plate 60 and the roller control device prevents the roller from rotating until power is supplied to the solenoid. When power is supplied to solenoid 40, solenoid 40 is magnetized causing latch 401 to move toward solenoid 40. This disengages projection 4011 of the latch form abutment 301 of disk 30 and allows disk 30 to rotate. The force generated by tension coil spring 70 is maintained since ends of spring 70 are supported by lift plate 60 and the housing of the electrophotographic apparatus. Since pole 601 is in slidable contact with cam 30, lift plate 60 rotates in a reciprocal fashion. This rotation places the sheets in a setting state in preparation for printing. Gear 20 receives driving via an gear from a driving mechanism. When roller 10 rotates, the uppermost sheet advances into the image forming device due to the frictional contact between the top sheet and roller 10. Thus, one device is able to both set paper prior to printing and to load the paper into the electrophotographic apparatus.

The roller control device of the present invention is advantageous in the small amount of space required to contain the device and the economical manufacturing cost of the roller control device. Although this preferred embodiment of the present invention has been disclosed for illustrative purposes, those skilled in the art will appreciate that various modifications, additions and substitutions are possible, without departing from the scope and spirit of the invention as disclosed in the accompanying claims. It is also possible that other benefits or uses of the currently disclosed invention will become apparent over time.

What is claimed is:

1. An electrophotographic apparatus, comprising:

a housing containing means for performing an electrophotographic process, said housing attached to means for accommodating a stack of a plurality of sheets of printable media while accommodating feeding of the sheets into the apparatus;

a clutch attached to said housing, regulating said feeding of the sheets from the stack, said clutch comprising:
- a solenoid attached to said housing;
- a latch pivotally attached to said housing and extending over said solenoid;
- a central axle rotatably attached to said housing and extending over said solenoid;
- a disk mounted on said central axle, having an abutment for engaging said latch; and
- a spring biasing said latch into engagement with said abutment for halting said feeding of the sheets;

a roller attached to said central axle and positioned over said stack to feed the sheets into said electrophotographic apparatus;

a paper aligner positioned in said accommodating means to set said sheets in position for feeding, said paper aligner comprising:
- a plate positioned under the stack and elastically attached to said housing supporting said stack; and
- a cam attached to said central axle, allowing said plate to move into a position for the sheets to be fed into said electrophotographic apparatus; and said solenoid, while activated, allowing said central axle to rotate and bring said cam into contact with said plate to position the stack by disengaging said latch from said disk, and feed a top sheet from the stack into said electrophotographic apparatus.

2. The electrophotographic apparatus of claim 1, further comprised of said abutment on said disk being along a radial edge.

3. The electrophotographic apparatus of claim 1, further comprised of said disk at being positioned on said central axle between a gear and said roller.

4. The electrophotographic apparatus of claim 1, further comprising said disk being positioned over said solenoid.

5. The electrophotographic apparatus of claim 1, further comprised of said cam being positioned on said central axle between said disk and said roller.

6. The electrophotographic apparatus of claim 1, further comprised of said plate having a pole slidably contacting said cam.

7. The electrophotographic apparatus of claim 1, further comprised of a tension coil spring connecting said plate to said housing.

8. An electrophotographic apparatus, comprising:

a housing enclosing means for performing an electrophotographic process, said housing attached to means for accommodating a stack of a plurality of sheet of printable media while accommodating feeding of the sheets into the apparatus;

a clutch attached to said housing, regulating said feeding of the sheets from the stack, said clutch comprising:

a solenoid attached to said housing;

a latch pivotally attached to said housing and extending over said solenoid;

a central axle rotatably attached to said housing and extending over said solenoid; and a disk mounted on said central axle having an abutment for engaging said latch;

a roller attached to said central axle, feeding the sheets into said electrophotographic apparatus;

a paper aligner mounted on said central axle, allowing said accommodating means to set said sheets in position for feeding; and said solenoid, while activated, allowing said central axle to rotate said paper aligner and to control said paper aligner to allow said accommodating means to position the stack by disengaging said latch from said disk and to feed a top sheet from the stack into said electrophotographic apparatus.

9. The electrophotographic apparatus of claim 8, with said paper aligning means, comprising:

a plate positioned under said stack and elastically attached to said housing; and a cam attached to said central axle, allowing said plate to move into a position for the sheets to be fed into said electrophotographic apparatus.

10. The electrophotographic apparatus of claim 9, further comprised of said abutment on said disk being along a radial edge.

11. The electrophotographic apparatus of claim 9, further comprised of said disk at being positioned on said central axle between a gear and said roller.

12. The electrophotographic apparatus of claim 9, further comprising said disk being positioned over said solenoid.

13. The electrophotographic apparatus of claim 9, further comprised of said cam being positioned on said central axle between said disk and said roller.

14. The electrophotographic apparatus of claim 9, further comprised of said plate having a pole slidably contacting said cam.

15. The electrophotographic apparatus of claim 9, further comprised of a tension coil spring connecting said plate to said housing.

16. The electrophotographic apparatus of claim 9, further comprising a spring biasing said latch into engagement with said abutment for halting the feeding of said sheets.

17. An electrophotographic apparatus, comprising:

a housing containing means for performing an electrophotographic process, said housing attached to means for accommodating a stack of a plurality of sheets of printable media while accommodating feeding of the sheets into the apparatus;

a clutch attached to said housing, regulating said feeding of the sheets from the stack, said clutch including:

a central axle rotatably attached said housing;

a disk mounted on said central axle; and a solenoid attached to said housing, controlling said central axle and said disk rotating about an axis passing a center of said central axle;

a roller attached to said central axle and positioned over said stack to feed the sheets into said electrophotographic apparatus;

a paper aligner positioned in said accommodating means to set said sheets in position for feeding, said paper aligner comprising:

a plate positioned under the stack and elastically attached to said housing, supporting said sheets; and a cam attached to said central axle, allowing said plate to move into a position for the sheets to be fed into said electrophotographic apparatus; and said clutch bringing said cam into contact with said plate to position the stack, feeding a top sheet into said electrophotographic apparatus by allowing said central axle and said disk to rotate.

18. The electrophotographic apparatus of claim 17, with said clutch further comprising:

a latch pivotally attached to said housing and extending over said solenoid;

said central axle extending over said solenoid;

said disk having an abutment for engaging said latch; and a spring biasing said latch into engagement with said abutment for halting the feeding of said sheets.

19. The electrophotographic apparatus of claim 18, further comprised of said plate having a pole slidably contacting said cam.

20. The electrophotographic apparatus of claim 18, further comprised of a tension coil spring connecting said plate to said housing.

* * * * *